United States Patent [19]

Kijima

[11] Patent Number: 5,045,276

[45] Date of Patent: Sep. 3, 1991

[54] METHOD FOR PRODUCTION OF INJECTION MOLDED POWDER METALLURGY PRODUCT

[75] Inventor: Yoshio Kijima, Tokyo, Japan

[73] Assignee: Sumitomo Metal Mining Company Limited, Tokyo, Japan

[21] Appl. No.: 595,409

[22] Filed: Oct. 11, 1990

[51] Int. Cl.[5] ..... B22F 7/00

[52] U.S. Cl. ..... 419/9; 419/10; 419/19; 419/23; 419/26; 419/27; 419/28; 419/36; 419/37; 419/38

[58] Field of Search ..... 419/9, 10, 19, 23, 26, 419/27, 28, 36, 37, 38

[56] References Cited

U.S. PATENT DOCUMENTS 3,617,358 11/1971 Dittrich ..... 419/65
4,569,821 2/1986 Duperray et al. ..... 419/65
4,698,269 10/1987 Narusch et al. ..... 419/27

*Primary Examiner*—Stephen J. Lechert, Jr.
*Attorney, Agent, or Firm*—Watson, Cole, Grindle & Watson

[57] ABSTRACT

An injection molded powder metallurgy product of highly satisfactory quality is obtained by a method which comprises injection molding mixture obtained by kneading a metal powder with a binder, depriving the molded mass of the binder while keeping the molded mass at least in contact with ceramic powder, projecting beads on the molded mass free from the binder, and thereafter sintering the molded mass studded with the beads.

9 Claims, 1 Drawing Sheet

METHOD FOR PRODUCTION OF INJECTION MOLDED POWDER METALLURGY PRODUCT

FIELD OF THE INVENTION

This invention relates to improvements in and relating to a method for the manufacture of a metal sintered part by the technique of injection molding powder metallurgy.

DESCRIPTION OF THE PRIOR ART

Heretofore, as means for manufacture of products possessing a three-dimensionally complicate shape and products possessing a thin-walled part or a knife-edge part, a method which comprises injection molding mixture obtained by kneading a metal powder with a binder, depriving the molded mass of the binder and, during the course of this removal of the binder, keeping the molded mass set on a bed of ceramic powder or partly or wholly buried in the bed of ceramic powder for the purpose of promoting the removal of the binder and enabling the molded mass to retain its shape, and thereafter sintering the molded mass free from the binder has been known to the art.

Though this method is highly effective in shortening the time for the, binder removal and preventing the molded mass from being deformed by heat, it is incapable of precluding the adhesion of the ceramic powder to the surface of the molded mass resulting from the binder removal. If the molded mass resulting from the binder removal is directly subjected to the sintering treatment, therefore, the adhering ceramic powder undergoes seizure through a reaction with the metal powder, induces impartation of a coarse skin to the sintered product, and entails defilement of the components of the composition. The molded mass, therefore, must be thoroughly purged of the adhering ceramic powder in advance of the sintering treatment. Heretofore, this removal of the adhering ceramic powder has been effected by (1) scrubbing with a forced current of air, (b) rubbing with a brush, or (3) ultrasonic cleansing in an alcohol solution.

In the aforementioned methods heretofore employed for the removal of the adhering ceramic powder, the method of (1) effects the removal insufficiently, the method of (2) necessitates a complicate work and, moreover, causes a scrape of the surface of the molded mass resulting from the binder removal and impairs surface coarseness and dimensional accuracy of the sintered product, and the method of (3) imparts adverse effects such as liberation of volatile matter to the molded mass during the subsequent step of sintering.

This invention, conceived in the light of the true state of affairs mentioned above, aims to provide a method which accomplishes simple and substantially perfect removal of adhering ceramic powder from the surface of a molded mass of a three-dimensionally complicate shape resulting from the removal of the binder without impairing surface coarseness and dimensional accuracy and exerting any adverse effect upon the next step of sintering or the product of the sintering.

SUMMARY OF THE INVENTION

The object described above is accomplished by a method which comprises preparing a molded mass deprived of a binder in accordance with the conventional method described above, then projecting beads on the molded mass resulting from the binder removal, then removing residual beads, when necessary, by air blowing, and sintering the molded mass.

DETAILED DESCRIPTION OF PREFERRED EMBODIMENT

The beads which are projected on the molded mass resulting from the binder removal may be made of any of the ordinary materials such as, for example, plastic material, glass, ceramic material, and metallic material.

The beads are projected at angles of at least two directions by the use of a showering device, a swinging nozzle, or a plurality of nozzles, for example.

The projection of glass beads not more than 50 μm in particle diameter in a two-direction mode using a swinging nozzle, for example, may be effected by using such conditions as 20 seconds of projection time, 30 cm of projection distance, and 1.0 kgf/cm$^2$ of projection pressure. For efficient quantity manufacture of sintered products, it is desirable to use, during the course of binder removal, a basket having meshes smaller than the diameter of products and larger than the particle diameter of the ceramic powder because the use of this basket allows the step of projection and the step of air blowing to proceed smoothly.

In the method of this invention, the glass beads to be projected by the two-direction mode by the use of a swinging nozzle have particle diameters of not more than 50 μm because use of glass beads having larger particle diameters entails impairment of surface coarseness. The projection pressure is desired to be in the range of 0.2 to 2.0 kgf/cm$^2$. The reason for this particular range is that the removal of ceramic powder is incomplete if the pressure is less than 0.2 kgf/cm$^2$ and the molded mass resulting from the binder removal acquires a rough surface and sustains fracture if the pressure exceeds 2.0 kgf/cm$^2$.

The projection is made at angles of at least two directions because the removal of the ceramic powder is carried out efficiently by causing the beads to impinge on the entire surface of the molded mass resulting from the binder removal.

EXAMPLE

Iron carbonyl powder having an average particle diameter of 5 μm and nickel carbonyl powder having an average particle diameter of 10 μm were homogeneously mixed in a gravimetric ratio of 98:2. In a pressure kneader or a kneader, the resultant metal powder and an organic binder were kneaded in a gravimetric ratio of 92:8 to produce 100 kg of a mixture.

Figure 1:
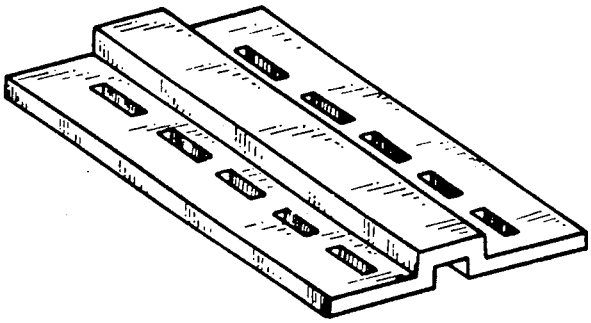
FIG. 1 and FIG. 2 are perspective view illustrating the shapes of products manufactured in a working example of this invention and a comparative experiment using the conventional method.
Figure 2:
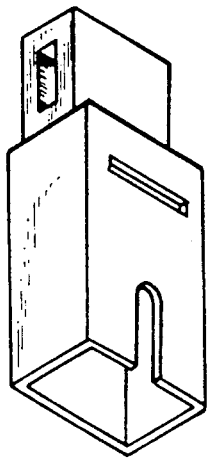

By injection molding this mixture, a shaped article having a construction illustrated in FIG. 1, measuring 55 mm in length, 8 mm in width, and 1.5 mm in thickness, and containing a plurality of slits and a shaped article having a construction illustrated in FIG. 2, measuring 9 mm in breadth, 12 mm in length, and 21 mm in height, having "burrs of molded mass" still stuck thereto, and containing blind parts and hollows cavities having angular cross sections were obtained.

These shaped articles were buried in a case made of a stainless steel sheet in the dimensions of 200 mm in breadth, 200 mm in length, and 50 mm in height and filled with $Al_2O_3$ powder having an average particle diameter of not more than 325 mesh.

The case containing these shaped articles was set in place in a binder removing furnace, heated to 300° C. in an atmosphere of nitrogen gas at a temperature incrasing rate of 20° C./hour, and cooled. The shaped articles resulting from the binder removal were taken out of the alumina powder. At this time, the shaped articles assumed a white surface because they were covered with $Al_2O_3$ powder.

Figure 3:
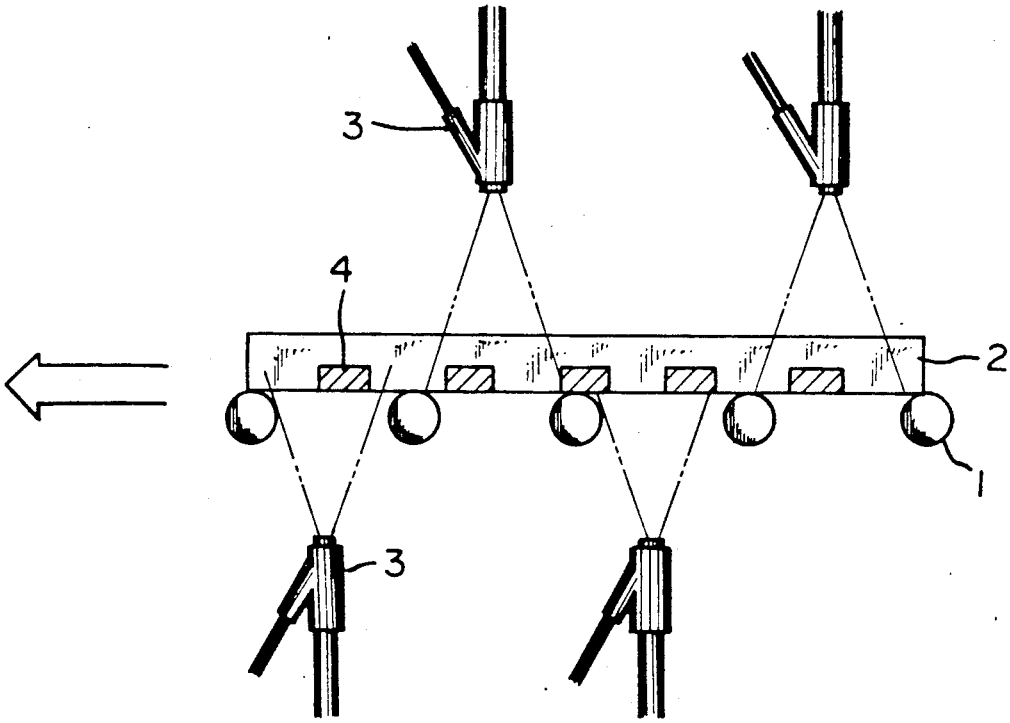
FIG. 3 is a schematic diagram of a continuous blasting device used in the step of projection as one embodiment of this invention.

The shaped articles resulting from the binder removal were placed in a metallic basket of 10 mesh and supplied to a continuous blasting device constructed as illustrated in FIG. 3. This device was provided with a roller conveyor 1 capable of successively conveying metallic baskets 2 and two upper and two lower projecting nozzles 3 adapted to swing. The reference numeral 4 denotes a molded article resulting from the binder removal.

The beads used for the projection were spherical glass beads having an average particle diameter of not more than 50 μm. The projection pressure was set at 1.0 kgf/cm$^2$, the projection distance was set at 30 cm, and the swinging angle was adjusted to 40 degrees in a plane vertical to the paper surface. The projection was continued for 20 seconds, with the conveyor speed set at 60 cm/ minute. After the projection of beads, the shaped articles resulting from the binder removal retained the surface condition of the molded masses because the alumina powder had been substantially completely removed from the surfaces of the shaped articles, the slits, the blind hole parts, and the surfaces within the hollow cavities.

The beads remaining within the blind holes were blown out with a forced current of air used for several seconds under a pressure of 2.0 kgf/cm$^2$. The shaped article having "burrs of molded mass" stuck thereto was thoroughly deprived of the "burrs of molded mass" in consequence of the projection of beads.

These shaped articles were supplied to the step of sintering, to afford sintered products. These products were free from seizure of $Al_2O_3$ powder or a coarse skin. By chemical analysis, they were found to have undergone no defilement of their components. Thus, the products thus obtained were found to possess a flawless quality.

CONVENTIONAL EXAMPLE

Sintered products were obtained by following the procedure of Example, excepting the removal of $Al_2O_3$ powder adhering to the surface of the molded mass was tried with 1 minute's air blowing under a pressure of 2.0 kgf/cm$^2$ instead of the projection of beads.

After the air blowing, the surfaces of molded masses were found to be covered throughout with a thin layer of seized $Al_2O_3$ powder. The "mold burrs" continued to remain on the products.

When these molded masses were directly subjected to the sintering treatment, the surfaces of the sintered products were smeared with seizure of $Al_2O_3$ powder and impaired in appearance with a coarse skin. Thus, the sintered products suffered from poor quality. Further, the "burrs of molded mass" which were rigidified by sintering called for a troublesome manual work for their removal.

This invention, as described above, allows simple and substantially complete removal of ceramic powder from the surface of a molded mass resulting from the step of binder removal without impairing surface coarseness and dimensional accuracy and ensures supply of a molded mass excellent in quality and free from the binder to the subsequent step of sintering.

It has been confirmed that this invention can be fully adapted through proper adjustment of the conditions of the projection of beads, for the manufacture of a small part of complicate shape which has been heretofore considered to allow no easy removal of ceramic powder. This invention also permits removal of "burrs of molded mass" produced during the course of molding or segments of the mixture adhering to the surface of the molded mass and consequently improves the quality of the sintered product. In the manufacture of an injection molded powder metallurgy product, this invention is highly effective in improving the quality of the product.

What is claimed is:

1. A method for the production of an injection molded powder metallurgy product, which method comprises injection molding a mixture obtained by kneading a metal powder with a binder, depriving the molded mass of said binder while keeping said molded mass at least in contact with ceramic powder, projecting beads on said molded mass free from said binder, and thereafter sintering the molded mass studded with said beads.

2. A method according to claim 1, wherein beads remaining after said projection are removed by air blowing.

3. A method according to claim 1, wherein said beads are made of a plastic material, glass, ceramic or a metallic material.

4. A method according to claim 1, wherein said beads are projected at angles of at least two directions by the use of a showering device, a swinging nozzle, or a plurality of nozzles.

5. A method according to claim 1, wherein said removal of the binder is effected on said injection molded mass placed on a bed of ceramic powder.

6. A method according to claim 1, wherein said removal of the binder is effected on said injection molded mass buried at least partly in a bed of ceramic powder.

7. A method according to claim 5 or claim 6, wherein said injection molded mass and said ceramic powder are received in a basket having meshes smaller than the diameter of the product and larger than the particle diameter of said ceramic powder.

8. A method according to claim 1, wherein said beads have particle diameters of not more than 50 μm.

9. A method according to claim 1, wherein said beads are projected with a pressure in the range of 0.2 to 2.0 kgf/cm$^2$.

* * * * *